United States Patent [19]

Huang

[11] Patent Number: 4,685,038

[45] Date of Patent: Aug. 4, 1987

[54] FOLDABLE LAMPSHADE FOR A HANGING LAMP

[76] Inventor: Ming C. Huang, No. 788, Chung-San Rd., Seh-Ko Tsun, Sen-Kang Hsian, Taichung Hsien, Taiwan

[21] Appl. No.: 810,059

[22] Filed: Dec. 17, 1985

[51] Int. Cl.[4] ..... F21V 1/06

[52] U.S. Cl. ..... 362/352; 362/147; 362/406; 362/294

[58] Field of Search ..... 362/147, 253, 352, 404–406, 362/96, 294

[56] References Cited

U.S. PATENT DOCUMENTS

| | | | |
|---|---|---|---|
| 1,872,453 | 8/1932 | Holdeman | 362/352 |
| 3,769,504 | 10/1973 | Hesse et al. | 362/352 |
| 4,277,822 | 7/1981 | Weber et al. | 362/352 |
| 4,467,405 | 8/1984 | Weber | 362/352 |

FOREIGN PATENT DOCUMENTS

| | | | |
|---|---|---|---|
| 128054 | 5/1932 | Fed. Rep. of Germany | 362/352 |

*Primary Examiner*—E. Rollins Cross

*Attorney, Agent, or Firm*—Charles E. Pfund

[57] ABSTRACT

A hanging lamp can be folded in a compact size so as to ease packaging and shipment. The hanging lamp includes a foldable lampshade and a switch housing having a plurality of bendable lamp tube attached thereto. A plurality of ribs of the lampshade extend downwardly and outwardly from a top centerpiece forming a dome-shaped frame structure. Each rib includes an upper rib segment and a lower rib segment connected with each other by a pivot pin. A spring is disposed around the pivot pin and biases the lower rib segment away from the upper rib segment in a transverse direction so as to ease folding up the lower rib segment against the upper rib segment. The bendable lamp tube can also be bent inwardly so that the hanging lamp occupies little space in shipment.

4 Claims, 2 Drawing Figures

FOLDABLE LAMPSHADE FOR A HANGING LAMP

BACKGROUND OF THE INVENTION

The present invention relates to a foldable lampshade, particularly to a foldable lampshade for a hanging lamp. Desiring to decorate elegantly the interior of their homes, contemporary people tend to be fastidious about home furnishings. A hanging lamp is one furnishing which has attracted a great deal of attention from homemakers and interior decorators. As a consequence, hanging lamps have become become more and more bulky and elaborate, so as to afford designers a great latitude to exhibit their talents in diversifying the outer appearance of the lamp. The bulkiness of the modern hanging lamp is a serious problem in shipment. Thus, it is attempted in this invention to reduce the space occupied by bulky lamps so as to ease their packaging.

SUMMARY OF THE INVENTION

It is an object of this invention to provide a lampshade which is foldable so that it can be accommodated in only a limited space when being shipped.

It is another object of this invention to provide a lampshade which is foldable but which maintains diversity in its outer appearance.

In accordance with this invention, a foldable lampshade for a hanging lamp comprises: a centerpiece, a plurality of ribs radially extending from said centerpiece, each including an upper rib segment and a lower rib segment, said upper rib segment having a free end pivotably connected with an upper end of said lower rib segment, said upper end being biased from said free end in a transverse direction, said lower rib segment having a crook portion disposed at a lower end of said lower rib segment to form a holding groove; and a plurality of shade segments, each with two lateral sides, the thickness of each lateral side being slightly less than a transverse space defined by said lower rib segment and said crook portion so that each said shade segment can be held in the two adjacent grooves.

In accordance with another aspect of this invention, the ribs are made of flexible material.

In accordance with a further aspect of this invention, the lower rib segment has a longitudinally extending outer ridge portion for pressing said shade segment against said crook portion so as to clamp said shade segment.

In accordance with still another aspect of this invention, the foldable lampshade can be mounted on a support by means of engaging a hollow screw shaft provided on the support, with a tapped hole in the upper surface of a switch housing disposed under the centerpiece of said lampshade. The switch housing includes a bendable lamp tube disposed on the lower surface of the switch housing and a socket shell, provided at a free end of said bendable lamp tube, adapted for receiving a light bulb.

The presently exemplary preferred embodiment will be described with reference to the following drawings, in which:

DETAILED DESCRIPTION OF THE PREFERRED EMBODIMENTS

Figure 1:
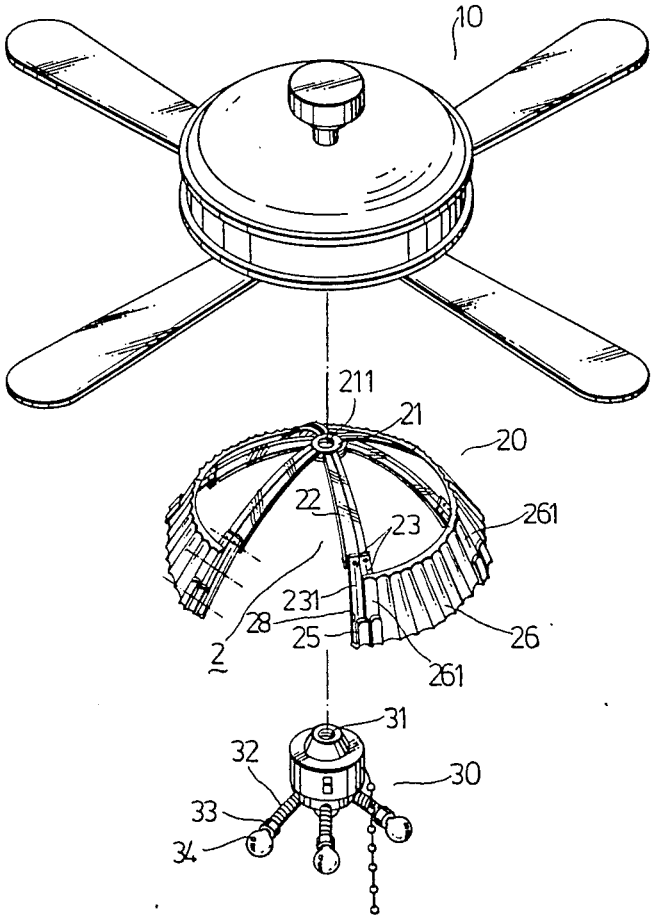
FIG. 1 is an exploded view of an embodiment of this invention in cooperation with a ceiling fan.
Figure 2:
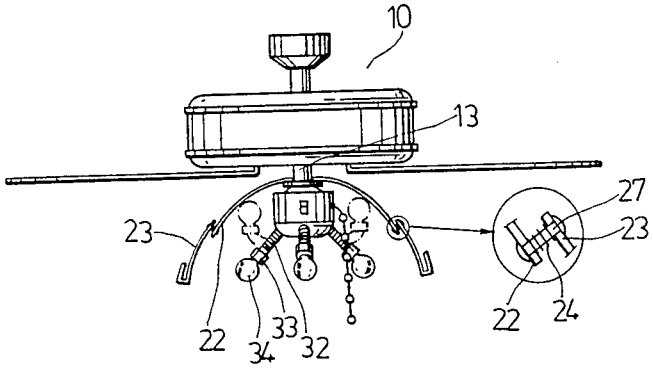
FIG. 2 is a partial sectional side view of the embodiment.

Now referring to FIGS. 1 and 2, there is shown a hanging lamp in combination with a ceiling fan 10. The hanging lamp includes a lampshade 20 and a switch housing 30. The lampshade 20 is dome-shaped and includes a centerpiece 21 which has a center hole 211 for mounting on a hollow screw shaft 13 of the ceiling fan 10. A plurality of ribs extend radially and downwardly to form a dome-shaped frame structure. The rib 2 includes an upper rib segment 22 and a lower rib segment 23. The free end of the upper rib segment 22 is pivotably connected to an upper end of the lower rib segment 23 with a rivet 27 and in a transverse direction. A spring 24 is disposed around the rivet 27 and biases the lower rib segment 23 from the upper rib segment 22 in a transverse direction. At the lower end of the lower rib segment 22, there is suspended a crook portion 25 which forms with the lower end of the lower rib segment 22 a holding groove 28. A shade segment 26 has its two lateral sides 261 received in the two adjacent holding grooves 28. Preferably, a pair of ribs are arranged in a side-to-side manner so that the two lateral sides 261 of the two adjacent shade segments 26 can abut upon each other without noticeable clearance so as to form a continuous contour of a shade. Preferably, the lateral side 261 of segment 26 is formed in a shape corresponding to the shape of the crook portion 25 and the thickness of the lateral side 261 is slightly less than the space between the lower rib segment 23 and the crook portion 25. In order to secure the firmness of the engagement, preferably, a longitudinally extending ridge 231 is provided on the outer surface of the lower rib segment 23. Due to the flexibility of the ridge 231, the lateral side 261 will be pressed against the inner surface of the crook portion 25. When the packaging of the lamp is desired, the shade segments 26 is first disengaged from the holding groove 28, and the lower rib segment 23 is folded up against the upper rib segment 22. In view of the action of the spring 24, such a folding action can be easily and smoothly achieved.

The switch housing 30 has a tapped hole 31 in the center of its upper surface. A plurality of bendable lamp tubes 32 extend outwardly and downwardly from the periphery of a lower surface of the switch housing 30. At the free end of each bendable lamp tube 32, there is provided a socket shell 33 for receiving a lamp bulb 34. Whenever needed, the lamp tube can be bent inwardly to spare space in shipment, By screwing the tapped hole 31 on the hollow screw shaft 13 of the ceiling fan 10, the lampshade can be fixedly mounted on the screw shaft 13. The power cord (not shown) can be led through the axial hole of the screw shaft 13, the center hole of the centerpiece 21 and the tapped hole 31 into the switch housing 30.

While the preferred embodiment has been explained, it is clear that any modifications and variations can be made without departing from the spirit of the preferred embodiment. Thus, the scope of the invention shall be limited by the appended claims, which shall be afforded the broadest interpretation they deserve.

I claim:

1. A foldable lampshade comprising:

a center piece having a plurality of curved ribs extending radially and downwardly from said center piece, each of said curved ribs having a bottom free end;

a plurality of lower rib segments each having an upper free end to be connected to a respective one of the bottom free ends of said curved ribs and a lower free end having an upwardly turned crook portion to define a holding groove;

pivot studs each with two end heads penetrating and connecting the upper free ends of said lower rib segments and the bottom free ends said curved ribs;

tension spring members on said pivot studs between said upper free ends and said bottom free ends for biasing said upper and bottom ends against the end heads of said studs so as to rigidly hold said lower rib segments to said curved ribs; and shade segments oriented annularly around said lower rib segments, each shade segment having two lateral sides fitted snugly in the holding grooves of said lower rib segments.

2. A foldable lampshade according to claim 1, wherein said curved ribs and said lower rib segments are made of flexible material.

3. A foldable lampshade according to claim 1, wherein each of said lower rib segments has a longitudinally extending outer ridge portion for pressing a said shade segment against a said crook portion so as to clamp said shade segment thereto.

4. A foldable hanging lamp fixture for use in supporting a foldable lampshade according to claim 1, the center piece of said foldable lampshade having a central hole and the thickness of each of the lateral sides of said shade segments being slightly less than a space defined by said lower rib segments and said crook portions so that each said shade segment can be held in two adjacent holding grooves, said fixture comprising a hollow screw shaft for accomodating a power cord;

a switch housing having a threaded hole in its upper surface for accommodating said power cord and for mounting the center piece of said lampshade on said hollow screw shaft by screwing said threaded hole on said hollow screw shaft;

a bendable lamp tube disposed on the lower surface of said switch housing; and a socket shell provided at a free end of said bendable lamp tube adapted for receiving a light bulb.

* * * * *